United States Patent [19]

Arrowsmith

[11] 4,248,255

[45] Feb. 3, 1981

[54] FLOATING CANOPY

[76] Inventor: Charlotte A. Arrowsmith, 1611 Exley Ave., Las Vegas, Nev. 89104

[21] Appl. No.: 950,427

[22] Filed: Oct. 11, 1978

[51] Int. Cl.[3] ..... A45F 1/14; C04F 10/00

[52] U.S. Cl. ..... 135/5 R; 5/434

[58] Field of Search ..... 135/5 R, 6, 5 E, 16, 135/DIG. 9; 297/184, DIG. 1, DIG. 3; 9/347; 5/434

[56] References Cited

U.S. PATENT DOCUMENTS

| | | | |
|---|---|---|---|
| 2,070,484 | 2/1937 | Jones | 135/5 R |
| 2,561,931 | 7/1951 | Kleiser | 135/5 R |
| 2,615,459 | 10/1952 | Adams | 135/5 R |
| 3,161,897 | 12/1964 | Hill | 9/347 |
| 4,100,633 | 7/1978 | Pintos | 135/5 R |

FOREIGN PATENT DOCUMENTS

| | | | |
|---|---|---|---|
| 1417654 | 10/1965 | France | 135/5 R |
| 456064 | 7/1968 | Switzerland | 135/5 R |

*Primary Examiner*—Reinaldo P. Machado
*Attorney, Agent, or Firm*—Seiler & Quirk

[57] ABSTRACT

A floating canopy for use in association with a floating body supporting device has a rigid flat base, a vertical support member, and an upper canopy frame. Flotation means associated with the base maintains the canopy in upright position when in water. The vertical support member may be detached from the base and used on a lawn chair by attaching with a C-clamp.

8 Claims, 6 Drawing Figures

FLOATING CANOPY

BACKGROUND OF THE INVENTION

This invention relates to a canopy for use as a beach or swimming pool accessory. More particularly it relates to a floating canopy for use in conjunction with a floating body support member, such as an air mattress.

In recent years, a large variety of new products have been developed for use in recreational bathing activities at the beach, lakes, or in swimming pools. For body flotation, the conventional automobile tire inner tube has been replaced by a wide variety of flotation devices such as inflatable boats, air mattresses, circular life preservers, rigid foam boards, inflatable animal-shaped toys, and the like. Users may lie on these raft-type devices for many hours, relaxing and enjoying the sun. At the present time, however, there is no convenient way to shield any portion of the user's body from the sun while lying on these rafts. For instance, a bather may wish to shade his face from the sun, particularly when reading, or to prevent overexposure.

While many portable shade-rendering devices are known, none are intended for use independently with a floating raft. For example, Boyd, U.S. Pat. No. 2,737,193, discloses a bed canopy having a tubular frame, the bottom portion of which is inserted under a bed mattress. Moore, U.S. Pat. No. 1,921,984, discloses a portable combined sunshade and headrest having a wire frame. Canvas stretched across the lower portion of the frame supports the user's head, while a raised parallel strip of canvas located above the head support acts as a sunshade. A similar portable sunshade is shown in Jones, U.S. Pat. No. 2,070,484. Jones discloses a pillow having an upholstery filling useful as a headrest, a vertical back panel comprising canvas on a wire frame, and a similar horizontal panel useful as an awning. The device can be folded for use as a handbag. However, the Jones pillow cannot be used in the water. Another similar beach pillow is shown in Kleiser, U.S. Pat. No. 2,561,931. This patent discloses a horseshoe shaped inflatable pillow useful as a headrest, with two vertical support rods attached thereto for mounting a visor.

it is an object of the present invention to provide a floating canopy which can be used independently with a floating raft, but does not require attachment to the raft. It is another object of the invention to provide a floating canopy wherein the awning portion is easily detached from the floating base for use with a chair. It is a further object of the invention to provide such a device which is easily portable, and which can be folded and stored flat. These and other objects of the invention will be more easily understood through the following detailed description of a specific embodiment of the invention.

SUMMARY OF THE INVENTION

A floating canopy comprises a tubular frame having a flat base, a vertical rigid support, and canopy support means, and flotation means for imparting buoyancy to the base portion.

BRIEF DESCRIPTION OF THE DRAWINGS

The invention is most easily understood with reference to the drawings, in which.

DETAILED DESCRIPTION OF THE INVENTION

Figure 1:
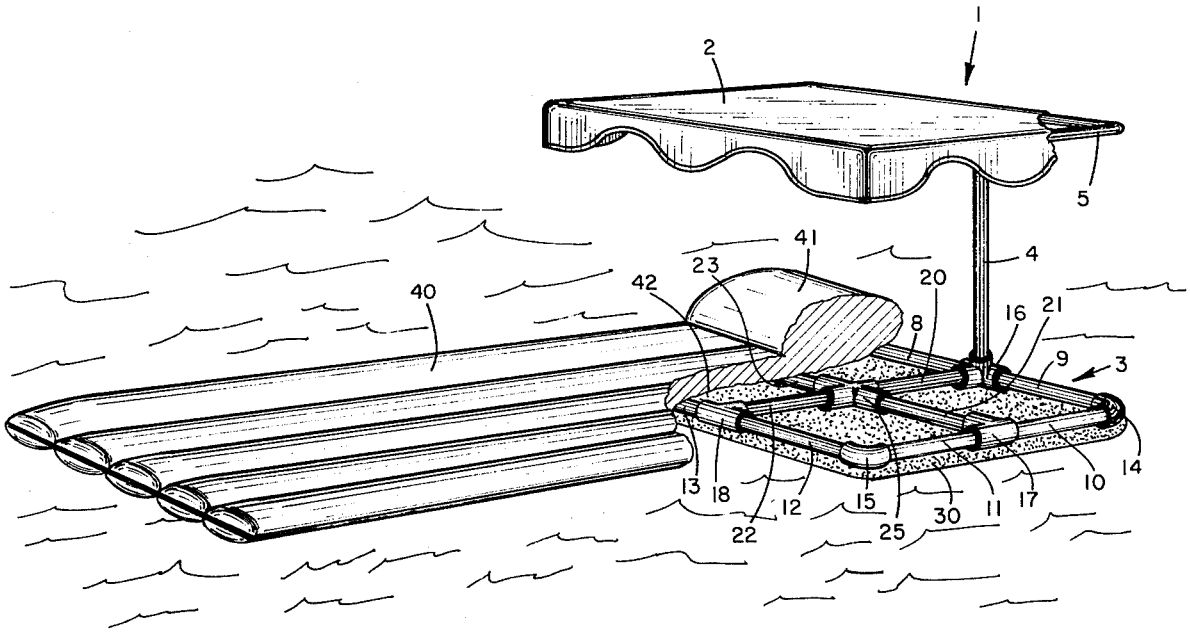
FIG. 1 is a perspective view of the canopy of the invention shown in use with an air mattress.

Referring to FIG. 1, floating canopy 1 consists of a canvas awning portion 2 supported on a rigid frame constructed of hollow plastic tubing. The frame consists of a lower base portion 3, a rigid vertical support portion 4, and a rectangular horizontal awning support 5. The rectangular base of the frame is constructed from a series of segments of plastic tubing connected through tees and elbows; for example, tubing segments 8, 9, 10, 11, 12, and 13 are connected through elbows 14 and 15, and tees 16, 17, and 18. Corresponding tees and elbows, not shown in FIG. 1, complete the rectangular frame. Additional tubing segments 20, 21, 22, and 23 attach to the tees and to cross 25, forming cross members which add to the structural stability of the base and also assist in maintaining the buoyancy member 30 in place of the canopy. While the frame members may be of any lightweight rigid material, plastic tubing such as polyvinyl chloride pipe of about $\frac{3}{4}''$ diameter, which is commonly used for lawn sprinkler installations, has proven very satisfactory. These pipes and fittings are conventional and commercially available.

FIG. 1 shows an air mattress 40 as used in combination with the floating canopy. No means of connection of the canopy to the raft is required; the base portion of the canopy is simply slid underneath the headrest section 41 of the raft, and the upward buoyant force of the frame lifts the base of the canopy up against the bottom surface 42 of the raft. The friction between the raft and the base of the canopy maintains the canopy in place underneath the top of the raft. Since no physical connection exists between the raft and the canopy, buoyancy is provided to the base of the canopy by a slab 30 of rigid, nonabsorbent, cellular polystyrene foam. This material is lightweight and durable, and is easily attached to the base of the frame with glue, wire, or the like. Any equivalent buoyancy-imparting device may be used in conjunction with the base of the frame, as long as sufficient buoyancy is obtained to float the entire canopy structure. A small inflatable air mattress, cork, or the like are useful alternatives.

Figure 3:
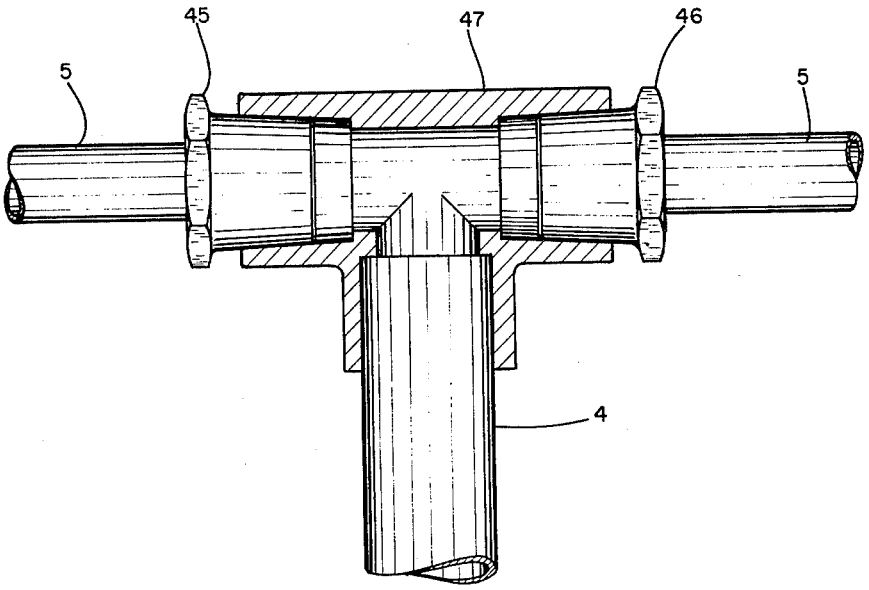
FIG. 3 is a view of the swivel portion of the canopy frame.

The upper frame member, awning support 5, is a continuous piece of rigid plastic tubing having its ends glued into the female portions of plugs 45 and 46. The male ends of plugs 45 and 46 slide into the openings of tee 47, providing a friction fit but permitting easy tilting of the frame 5 upwardly or downwardly as desired. Vertical support member 4 also terminates in tee 47, as shown in FIG. 3. While the particular adjustment mechanism shown is functional, any of many well known techniques for adjusting the angle of the canopy may be used.

Figure 4:
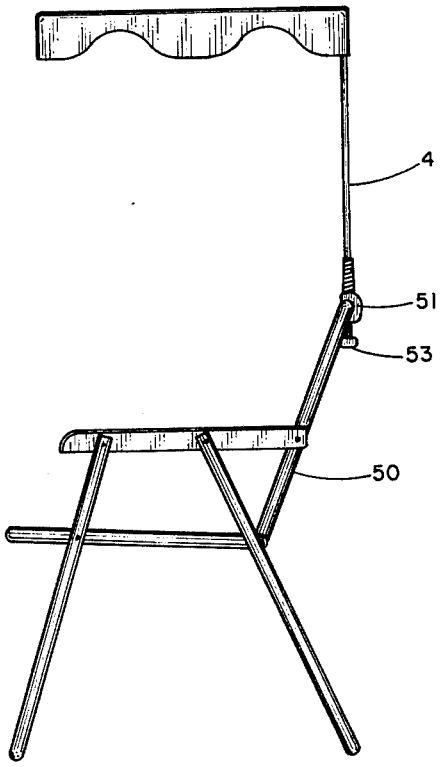
FIG. 4 shows the canopy portion of the apparatus of the invention detatched from the base and attached to a lawn chair by means of a C-clamp.
Figure 5:
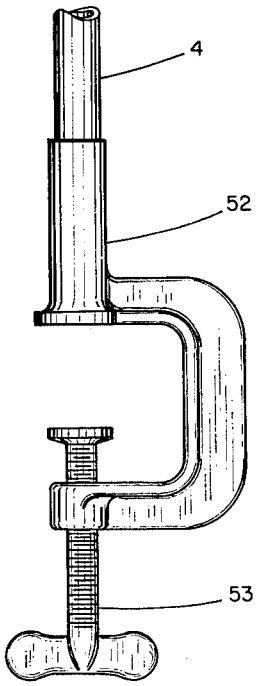
FIG. 5 is a detailed view of the C-clamp.

In a preferred embodiment of the invention, the vertical support member 4 is slideably engaged in the upper portion of double tee 16. This not only permits rotation of the awning around a vertical axis relative to the base, but permits easy removal of the awning from the flotation portion of the frame. As shown in FIG. 4, the canopy may be used in conjunction with a beach or lawn chair 50 by mounting vertical support member 4 on C-clamp 51. The C-clamp has a vertical hollow tubular portion 52 having an inside diameter slightly greater than the outside diameter of tubular member 4, as shown in FIG. 5. Accordingly, after C-clamp 51 is attached to the chair arm or back by means of thumb screw 53, the lower end of shaft 4 can be easily placed in sleeve 52 for mounting the canopy over the chair.

Figure 6:
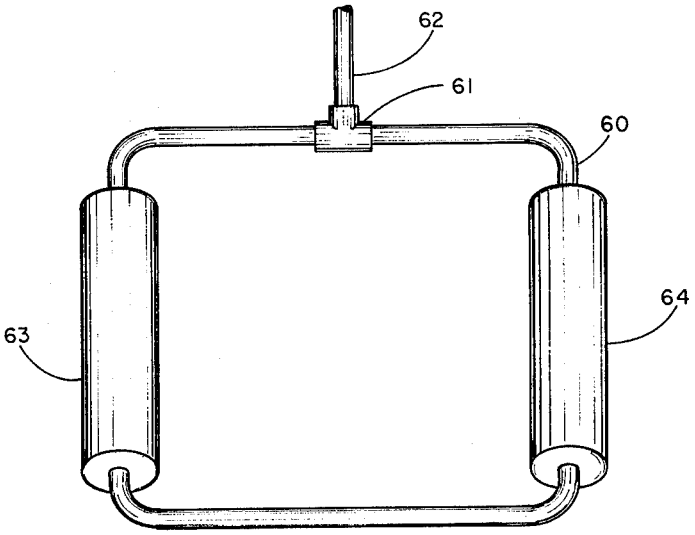
FIG. 6 is a view of an alternative frame design.

A particularly preferred embodiment of the invention is shown in FIG. 6 of the drawings. In this embodiment, the base portion of the frame is constructed from a single piece of flexible plastic tubing 60 which is bent into a rectangular configuration, with the ends thereof joined in tee 61. The vertical canopy support 62 extends upwardly from the tee. Buoyancy is contributed by two elongated polystyrene foam cylinders 63 and 64, which are mounted concentrically on the sides of the base. Each cylinder has an axial bore extending therethrough to recreive the tubing. If the awning is particularly heavy, a third cylinder may be used at the front of the base; normally, the side cylinders will be sufficient. While cylindrical floats have been shown, floats having different shapes or sizes may also be used.

Figure 2:
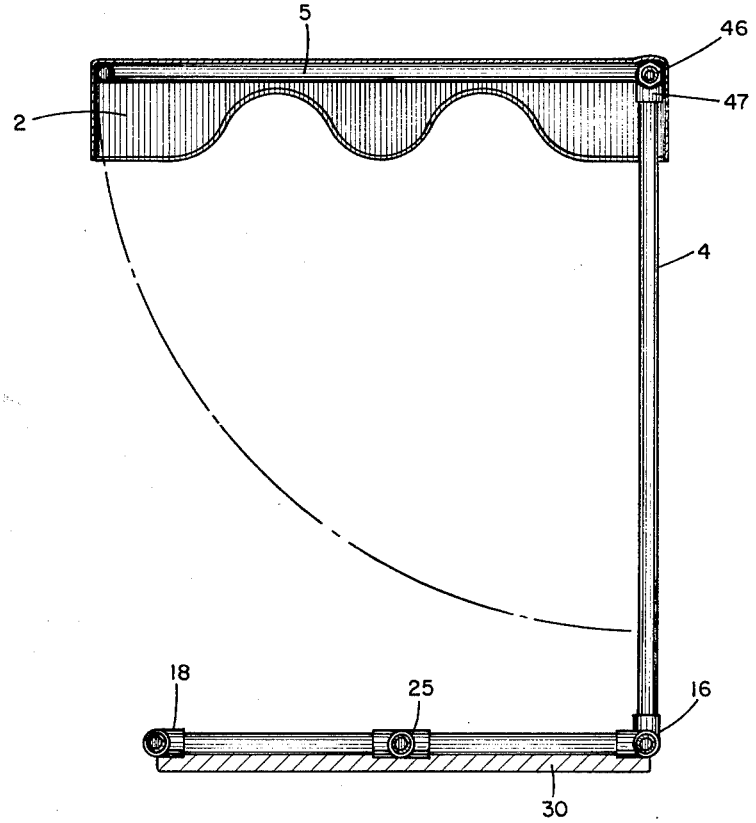
FIG. 2 is a side section view of the canopy.

The canopy of the invention is easily dissembled and folded for carrying or storage. The base is removed by sliding tubular member 4 from double tee 16, and the tubular member 4 is folded up against the top of the canopy as indicated in FIG. 2. Accordingly, the entire floating canopy folds into a small flat package.

Many variations on the canopy of the invention may be made within the spirit and scope of the invention. For example, the cross members in the base of the frame may be eliminated, as long as the flotation member 30 can be adequately secured to the frame. If desired, the polystyrene can be molded totally around the base framing structure, thereby concealing the tubing from view. This embodiment is more esthetically pleasing. Alternatively, canvas strips may be suspended across the top and bottom of the base of the frame, with the flotation member being retained between the strips. Accordingly, the invention should not be limited by the preceding description of a specific embodiment thereof, but should rather be limited only by the following claims.

I claim:

1. In combination, a floating body-supporting mattress, a floating canopy in frictional engagement with said mattress comprising a plastic tubular frame having a flat base portion, upright rigid support means extending upwardly from a central portion of an edge of the base, and canopy support means, and flotation means secured to the base portion for imparting buoyancy, said flotation means comprising a thin slab of rigid, non-absorbent foamed plastic, said canopy having sufficient buoyancy to maintain a location beneath the floating mattress in water by frictional contact between the base portion of the canopy and a lower surface of the mattress.

2. The floating canopy of claim 1 wherein the upright rigid support means is detachably mounted to the base portion of the frame.

3. The canopy of claim 1 also comprising clamp means for removably attaching a portion of the canopy comprising the upright rigid support member and canopy support means to a chair.

4. The floating canopy of claim 3 wherein said clamp means comprises a C-clamp having attachment means for fastening the clamp means to a chair, and means for attaching the rigid support member to the clamp means.

5. The floating canopy of claim 1 comprising swivel mounting means for attaching the canopy support means to the upright rigid support member at variable angles of inclination.

6. The floating canopy of claim 1 wherein the base portion consists of plastic tubing having a generally rectangular configuration.

7. The floating canopy of claim 6 wherein the flotation means comprises at least one elongated foamed plastic member mounted on the base portion.

8. The floating canopy of claim 6 wherein the flotation means comprises at least one rigid, elongated, foamed plastic member having a bore therethrough, said member having the tubing of the base portion threaded through said bore to secure the member to the frame.

* * * * *